United States Patent [19]

Doell

[11] Patent Number: 4,514,944

[45] Date of Patent: May 7, 1985

[54] SKYLIGHT AND MOUNTING THEREFOR

[75] Inventor: Aubrey C. Doell, Newport Beach, Calif.

[73] Assignee: Bristol Fiberlite Industries, Santa Ana, Calif.

[21] Appl. No.: 572,138

[22] Filed: Jan. 20, 1984

Related U.S. Application Data

[63] Continuation of Ser. No. 352,406, Feb. 25, 1982, abandoned.

[51] Int. Cl.[3] ..... E04B 7/18

[52] U.S. Cl. ..... 52/200

[58] Field of Search ..... 52/200, 72, 399; 49/498

[56] References Cited

U.S. PATENT DOCUMENTS

| | | | |
|---|---|---|---|
| 2,180,886 | 11/1939 | Thomas | 49/498 |
| 2,842,073 | 7/1958 | Huston | 52/200 |
| 3,417,527 | 12/1968 | Kiekhaefer | 52/200 |
| 4,235,056 | 11/1980 | Griffen | 52/397 |
| 4,327,532 | 5/1982 | Matthews | 52/200 |

*Primary Examiner*—John E. Murtagh
*Assistant Examiner*—Kathryn L. Ford
*Attorney, Agent, or Firm*—Whann & McManigal

[57] ABSTRACT

A skylight structure in which a plastic dome has a peripheral edge flange bonded by a bonding medium to an overlapping flange of a plastic mounting skirt in a manner such that the bonding medium encompasses the outer edge of the peripheral flange and extends between the confronting surfaces of the overlapping flanges to an inner locus edge spaced from the inner edge of the skirt flange, and wherein a sealing strip coextensive with said locus edge is retained between the overlapping flanges by an inner edge portion of the skirt flange. Provision is made for securing the mounting skirt to a roof curb structure with a continuous sealing member being interposed between the curb and an under surface of the peripheral flange. In a modified form two domes have peripheral flanges, bonded together and to a single skirt flange, and with a continuous sealing strip being interposed therebetween.

7 Claims, 5 Drawing Figures

FIG. 1
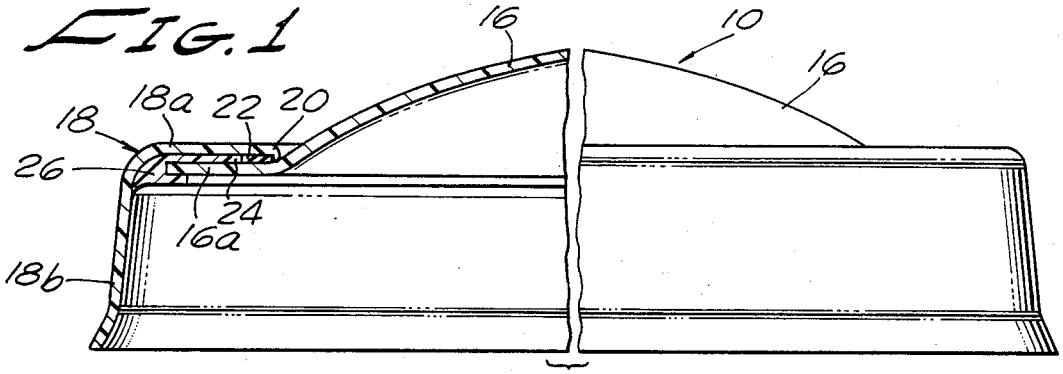
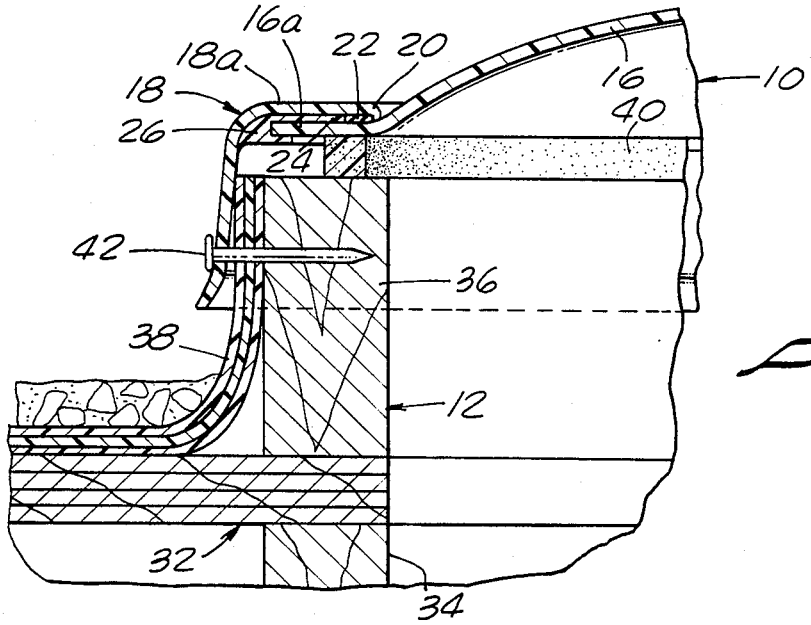
FIG. 2
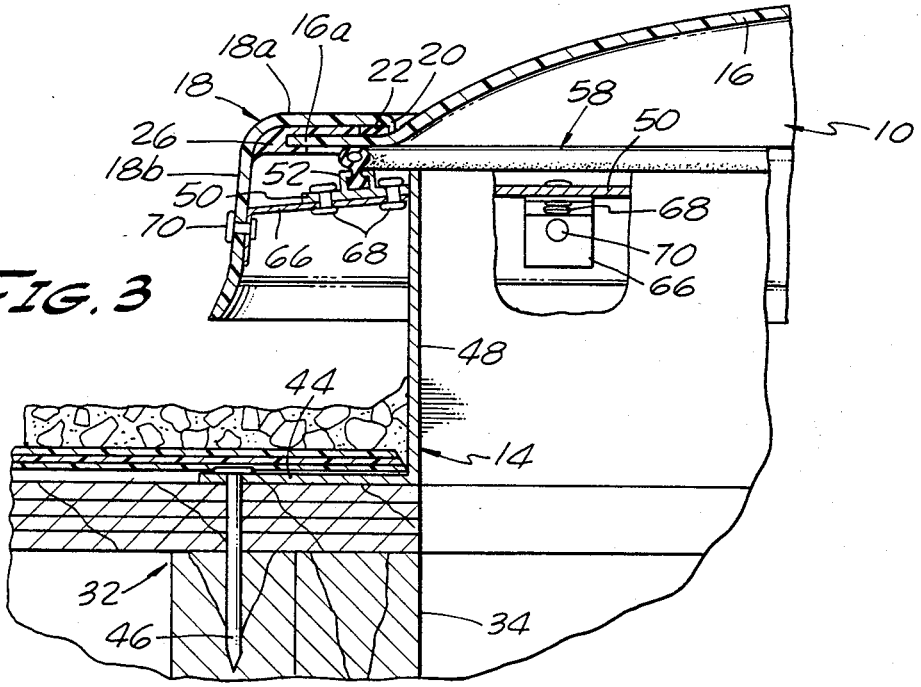
FIG. 3

SKYLIGHT AND MOUNTING THEREFOR

This application is a continuation of application Ser. No. 352,406, filed 2-25-82 now abandoned.

BACKGROUND OF THE INVENTION

The present invention relates generally to environmental control devices, and more particularly includes roof mounted light control devices, such as skylights.

For many years, skylights were conventionally manufactured from glass or plastic and provided with a metal retaining frame or skirt; and in order to allow for expansion and contraction under temperature changes were usually provided with a seal or gasket of rubber or other resilient material which was interposed between the skylight material and the retaining or mounting frame or skirt. These structures were inherently unsatisfactory, prone to leak, and difficult to maintain over extended periods of time.

In due course, many of the disadvantages and problems of the prior skylight structures were overcome by applicant's unique structurally designed arrangement wherein the skylight domes were constructed of an acrylic material and the retaining frame or skirt of fiberglass, whereby the material of the dome and material of the skirt would have substantially the same rates of expansion and contraction under temperature changes. The skylight dome was then bonded or fused by means of a suitable flowable bonding medium to the mounting skirt so as to provide, in effect upon setting, a one-piece structure and thereby eliminate the necessity of having to rely on the use of undependable gaskets, sealants or flow-through designs of the previously known structures.

Skylights embodying the previously noted bonded or fused concept were found to have numerous desirable advantages over the previously known structures. For example, the bonding medium has a fire-retardant characteristic, and serves to encapsulate the volatile exposed edges of the plastic material of the dome, and thus prevent ignition of these edges by exposure to flames in the case of a fire.

The bonded concept embodiment also eliminates the disadvantages of the formerly known designs having flow-through and weep holes which either became clogged with dirt or were not of sufficient size to carry off the water during extremely heavy rains. The use of a bonded fiberglass skirt instead of the formerly used steel or aluminum skirt provides a desirable energy-saving insulation against the conduction of heat or cold.

The present invention is concerned with refinements and improvements in the above-described bonded or fused concept of skylight construction, and includes:

1. A unique sealing strip arranged between the inner edge margin of the skirt flange and the overlapping flange of the plastic dome to seal against the entrance of moisture which could freeze in cold weather and damage the connecting bond or skirt structure.
2. A sealing strip positioned between the peripheral flanges of double-dome structures to prevent migration of the flowable bonding medium inwardly into the space between the domes, during the bonding operation.
3. An improved continuous sealing arrangement between the skylight dome periphery and the associated roof mounting curb structure.

SUMMARY OF THE INVENTION

The present invention is specifically concerned with the provision of unique sealing means in the fabrication of skylight dome structures and in their mounting on a roof-curb support, whereby leakage may be substantially eliminated, maintenance and repair reduced to a minimum, and operating efficiency maintained for long periods of time.

It is one object of the herein described invention to provide a unitary skylight structure in which a plastic dome has a peripheral flange bonded to a flange of a fiberglass frame or skirt, and wherein a sealing strip is embraced between the inner edge margin of the skirt flange and the overlapping peripheral flange of the plastic dome.

A further object is to provide a double-dome skylight structure in which two plastic domes have peripheral overlying flanges bonded together and to a flange of a fiberglass frame or skirt, and wherein a sealing strip is interposed between the peripheral flanges of the domes to prevent migration of the bonding medium inwardly into the space between the domes, during the bonding operation.

Another object is to provide a skylight structure according to either of the foregoing objects and means for mounting on a wood or metal roof-curb structure, wherein a continuous sealing member is interposed between the curb and a peripheral flange of the skylight dome.

Still another object is to provide a sealing member for sealing a skylight dome structure with respect to a mounting roof-curb, wherein the sealing member is of an extruded tubular configuration.

Further objects of the invention will be brought out in the following part of the specification, wherein detailed description is for the purpose of fully disclosing the invention without placing limitations thereon.

BRIEF DESCRIPTION OF THE DRAWINGS

Referring to the accompanying drawings, which are for illustrative purposes only:

FIG. 1 is a side elevational view, partly in section, of a single skylight dome structure embodying features of the present invention;

FIG. 2 is an enlarged fragmentary transverse sectional view illustrating the manner of mounting a skylight according to FIG. 1, on a wood type roof-curb with a continuous sealing element therebetween according to the present invention;

FIG. 3 is a similar view to that of FIG. 2, showing a metal roof-curb structure, and a tubular sealing element according to the present invention;

DETAILED DESCRIPTION OF SEVERAL EMBODIMENTS

Figure 5:
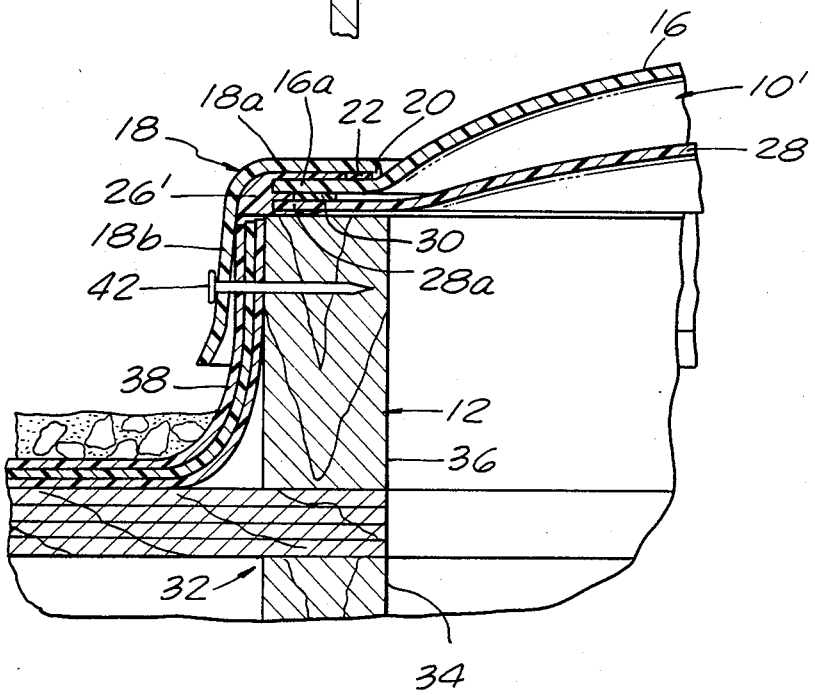
FIG. 5 is an enlarged transverse sectional view showing details of construction of a double skylight dome structure according to the present invention, and the manner in which it may be mounted on a wood roof-curb structure.

Referring more specifically to the drawings, for illustrative purposes, there is disclosed in FIG. 1 a skylight structure, as generally indicated by the numeral 10, and which is of single-dome construction. FIG. 5 discloses a double-dome type construction, as generally indicated by the numeral 10'. These skylight structures are arranged to be mountingly supported on roof-curb structures in the roof of a building for the environmental control of light, heat and cold, and the like in a manner well understood in the industry. For example, the skylight structure may be mounted upon a wood roof-curb as generally indicated at 12 in FIGS. 2 and 5, or a metal curb structure as generally indicated at 14 in FIG. 3.

Referring more specifically to FIG. 1, the skylight structure is disclosed as comprising a light transmitting dome element 16 formed of a suitable plastic such as an acrylic. The dome is fabricated to provide an outwardly extending peripheral flange 16*a*. A mounting frame or skirt 18 of fiberglass surrounds the dome element, this skirt having a generally angular cross section with an inwardly extending flange 18*a* and a generally downwardly extending depending flange 18*b*, these flanges being in substantially right angle relation. Referring again to the flange 18*a*, it will be observed that the innermost edge of this flange is formed so as to provide an abutment ledge 20 on its underside.

In the process of connecting the dome element 16 to the skirt 18, these elements are positioned in an inverted orientation to that shown in FIG. 1, and with a sealing strip 22 of neoprene or other suitable material being interposed between the overlapping flanges in abutment with the ledge 20. As thus positioned, this sealing strip initially holds the overlapping flanges in spaced apart relation to facilitate carrying out of the bonding operation to connect or fuse the overlapping flanges together. A flowable bonding medium having fire retardant characteristics is then applied and flows into the space between the flanges 16*a* and 18*a* to a locus edge 24 in which it abuts the sealing strip 22. The bonding medium also embraces the outer edge of the flange 16*a* as clearly shown in FIG. 1. The dome element 16 and mounting skirt 18 are thus intimately formed to provide a unitary structure in which these elements are fused or bonded by the bonding medium as indicated at 26 in FIG. 1.

A similar procedure is followed in fabricating a double skylight dome structure as shown in FIG. 5. In this instance, a second dome element 28 having a peripheral flange 28*a* is initially positioned and held with its peripheral flanges 28*a* in spaced apart relation to the flange 16*a* by means of an interposed sealing strip 30 of rubber, neoprene or other suitable material. Thus, when the bonding medium is applied to provide the connecting bond, the bonding material will flow into the space between the outer edge margins of the peripheral flanges 16*a* and 28*a*, as well as embracing the outer edge of the peripheral flange 28*a* of the second dome element 28. It will be apparent that the sealing strip 30 thus determines the extent of migration of the bonding medium between the peripheral flanges of the domes and also prevents flow of bonding material into the space between the light transmitting portions thereof.

Skylights of the single and double dome type, embodying the features of construction of the present invention are particularly adapted for mounting upon a variety of wooden or metal roof-curb structures in a manner which will minimize leakage.

A typical wooden roof-curb 12 is shown in FIGS. 2 and 5 in which the roof structure, as generally indicated at 32, defines a curb opening 34 which conforms to and communicates with the interior opening of a wooden roof-curb 36. Conventionally roof flashing 38 is extended upwardly over the outer surface of the roof-curb. When mounting the skylight structure, as shown in FIG. 1, on a conventional wooden roof-curb structure 12, in the manner shown in FIG. 2, a continuous weather strip seal 40 will be interposed between the upper edge of the roof-curb 36 and the overlying peripheral flange 16*a* of the dome element 16. The skylight is secured to the roof-curb by means of appropriate nails 42 which are driven through pre-drilled openings in the skirt flange 18*b*, these nails passing through the underlying roof flashing and into a holding position in the wooden roof-curb 36.

Figure 4:
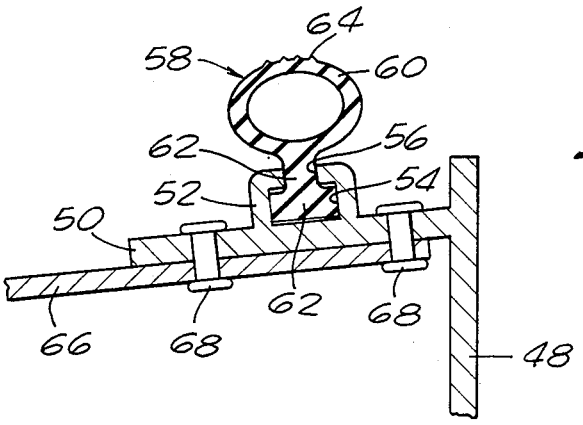
FIG. 4 is an enlarged fragmentary sectional view showing details of construction of the tubular sealing element extrusion and the manner in which it is mounted on the metal roof-curb.

Referring to FIGS. 3 and 4, there is disclosed a metal roof-curb 14 which is constructed to embody unique features in accordance with the present invention for attachment to the skylight structure and for supporting the sealing means between the curb and the skylight structure. The curb in this case is preferably formed from an aluminum extrusion which, in cross section comprises a bottom attaching flange 44 which is adapted to extend under the roofing material and to be secured to the underlying roof structure by means of suitable holding nails 46. A right-angled upstanding web 48 is fabricated to define a curb opening for communication with and conforming to the opening 34 of the roof structure.

As best shown in FIG. 4, the web 48 adjacent its upper edge is formed to provide a downwardly, outwardly inclined flange 50 which extends along the web 48 and is provided with a tubular rib portion 52 which is configured to provide a longitudinally extending groove or channel 54 which is in communication with a longitudinally extending upper restricted opening 56. The structure just described is adapted to mountingly receive an extruded tubular sealing member, as generally indicated by the numeral 58.

As will be seen in FIG. 4, the sealing member 58 in section comprises a tubular body portion 60 of generally ovate configuration, and which is provided along its underside with a projecting inverted T-shaped tongue 62 which is adapted to releasably be positioned in the channel 54 and with the neck portion thereof extending through the restricted opening 56, whereby to hold the sealing member in an operative position in which the opposite side of the body portion 60 may engage a peripheral adjacent flange of the skylight dome structure. Sealing engagement of the body structure 60 is augmented by providing a plurality of longitudinally extending spaced apart surface ridges, as indicated at 64. The sealing member 58 may be fabricated from any suitable extrudable material such as neoprene, rubber or the like.

As best shown in FIG. 3, the flange 50 also serves as a support for the skylight structure which is attached thereto by means of generally L-shaped brackets 66, one leg of which is secured to the flange 50 as by rivets 68, and the other leg to the skirt flange 18*b* as by a rivet 70.

From the foregoing description, it will be apparent that the skylight and mounting therefore as described accomplishes the stipulated objects as set out for the invention.

Various modifications may suggest themselves to those skilled in the art without departing from the spirit of my invention, and, hence, I do not wish to be restricted to the specific forms shown or uses mentioned, except to the extent indicated in the appended claims.

I claim:

1. In a skylight structure which includes a preformed plastic dome with an integral outwardly extending peripheral flange, a plastic mounting skirt having integral angularly related flanges, one of which extends inwardly and is positioned in overlying spaced lapped relation with respect to said outwardly extending peripheral flange, and an initially flowable bonding medium fixedly secures the overlapped flanges together and encompasses the outer edge of the outwardly extending peripheral flange and extends into the space between the confronting surfaces of the overlapped flanges to an inner locus edge spaced from the adjacent inner edge of the associated skirt flange, the improvement comprising:

a sealing strip coextensive with said locus edge, and having sealing surface engagements with the confronting surfaces of said overlapping flanges and said locus edge of said bonding medium, whereby to form a protective seal against the entrance of outside moisture into the space between the confronting surfaces and the locus edge of the bonding material.

2. A skylight structure according to claim 1, in which:

said sealing strip, during bonding of said overlapped flanges, confines the bonding means to said space and prevents its migration onto the dome surface inwardly of the inner edge of said one skirt flange.

3. A skylight structure according to claim 2, in which:

the inner edge margin of said one skirt flange extends over and embraces the inner adjacent edge of said sealing strip so as to maintain said sealing strip in a position for holding the overlapped flanges in spaced relation during bonding.

4. A skylight structure according to claim 1, in which:

a second dome is positioned in spaced relation below the first mentioned dome, and has a peripheral flange spaced below the peripheral flange of said first dome; and said bonding medium additionally embraces the marginal edge of the peripheral flange of the second dome.

5. A skylight structure according to claim 4, in which:

said bonding medium extends inwardly between the flanges of said first and second domes to an inner locus edge.

6. A skylight structure according to claim 5, in which:

a sealing strip is coextensive with said locus edge of the bonding medium between the dome flanges and is in sealing engagement with their confronting surfaces.

7. A skylight according to claim 1, which comprises:

an upstanding mounting curb positioned below the bonded skirt and dome, and having an upper end spaced below the outwardly extending flange of said dome, said upper end further having overlapping relation with respect to the other flange of said skirt;

means for securing said other flange of the skirt to said upper end of the curb; and a sealing member interposed between the upper end of said curb and said outwardly extending flange of said dome.

* * * * *